US009894936B2

(12) United States Patent
Krietzman

(10) Patent No.: US 9,894,936 B2
(45) Date of Patent: Feb. 20, 2018

(54) ZONED VAPORIZER

(71) Applicant: Mark Krietzman, Palos Verdes Estates, CA (US)

(72) Inventor: Mark Krietzman, Palos Verdes Estates, CA (US)

( * ) Notice: Subject to any disclaimer, the term of this patent is extended or adjusted under 35 U.S.C. 154(b) by 94 days.

(21) Appl. No.: 15/045,442

(22) Filed: Feb. 17, 2016

(65) Prior Publication Data

US 2016/0235123 A1 Aug. 18, 2016

Related U.S. Application Data

(60) Provisional application No. 62/116,926, filed on Feb. 17, 2015, provisional application No. 62/127,817, filed on Mar. 3, 2015, provisional application No. 62/184,396, filed on Jun. 25, 2015, provisional application No. 62/208,786, filed on Aug. 23, 2015, provisional application No. 62/270,557, filed on Dec. 21, 2015.

(51) Int. Cl.

| | |
|---|---|
| ***A24F 47/00*** | (2006.01) |
| ***H05B 1/02*** | (2006.01) |
| ***A24B 15/16*** | (2006.01) |
| ***H05B 3/14*** | (2006.01) |
| ***H05B 3/42*** | (2006.01) |

(52) U.S. Cl.

CPC ..... *A24F 47/008* (2013.01); *A24B 15/16* (2013.01); *H05B 1/0225* (2013.01); *H05B 1/0244* (2013.01); *H05B 3/146* (2013.01); *H05B 3/42* (2013.01); *H05B 2203/014* (2013.01); *H05B 2203/021* (2013.01); *H05B 2203/022* (2013.01)

(58) Field of Classification Search

CPC ..... A61M 11/042; A61M 15/06; A24F 47/008
See application file for complete search history.

(56) References Cited

U.S. PATENT DOCUMENTS

2015/0150308 A1* 6/2015 Monsees ..... A24F 47/006 131/329
2016/0255879 A1* 9/2016 Paprocki ..... H05B 1/0291

* cited by examiner

*Primary Examiner* — Ross Gushi

(57) ABSTRACT

Disclosed herein are methods and systems to vaporize or release organic material from plant material containing the organic material and the like, including utilizing zoned heating of a common chamber. A controller in signal communication with two or more heating elements each adjacent to a zone to be heated controls at least the heating of the elements.

17 Claims, 12 Drawing Sheets

ZONED VAPORIZER

RELATED APPLICATION

This application claims the priority to United States ("U.S.") Provisional Patent Application Ser. No. 62/116,926 entitled CARTRIDGE AND HEATER filed on 17 Feb. 2015, the disclosure of which is incorporated by reference herein in its entirety.

Additionally, this application also claims the priority to U.S. Provisional Patent Application Ser. No. 62/127,817 entitled MULTI ZONE VAPORIZER filed on 3 Mar. 2015, the disclosure of which is incorporated by reference herein in its entirety.

Furthermore, this application also claims the priority to U.S. Provisional Patent Application Ser. No. 62/184,396 entitled VAPORIZER DEVICE AND METHOD 25 Jun. 2015, the disclosure of which is incorporated by reference herein in its entirety.

Furthermore, this application also claims the priority to U.S. Provisional Patent Application Ser. No. 62/208,786 entitled VAPORIZER CARTRIDGE AND HEATER 23 Aug. 2015, the disclosure of which is incorporated by reference herein in its entirety.

Still furthermore, this application also claim priority to U.S. Provisional Patent Application Ser. No. 62/270,557 entitled THIN CONVECTION VAPORIZER filed 21 Dec. 2015 the disclosures of which is incorporated by reference herein in their entirety as if fully set forth herein.

BACKGROUND OF THE DISCLOSURE

1. Field of the Disclosure

The present disclosure relates generally to heating system and device that releases organic residues from essential oils, extracts and plant based material upon appropriate heating and releases or vaporizes the organics without combustion.

2. Related Art

Vaporizer for plant based materials and essential oils and exist. Vaporizers which allow a fluid gas containing the vapor and other residues to follow a fluid pathway from source of vapor to user inhalation exist. Cannabis and other botanicals have been known in the art to be vaporized or burned to release organic material in the form of inhalable material. Vaporizing at correct temperatures can boil off the oils for inhalation without combusting the plant material.

Cannabis sativa contains over 421 different chemical compounds, including over 60 cannabinoids. Cannabinoid plant chemistry is far more complex than that of pure THC, and different effects may be expected due to the presence of additional cannabinoids and other chemicals. Eighteen different classes of chemicals, including nitrogenous compounds, amino acids, hydrocarbons, carbohydrates, terpenes, and simple and fatty acids, contribute to the known pharmacological properties of cannabis.

Cannabis, for example has a narrow range at which it can be heated to release THC (Tetrahydrocannabinol (THC), or more precisely its main isomer (−)-trans-$\Delta^9$-tetrahydrocannabinol) and CBDs (Cannabidiol loosely referring to as many as 85 identified compounds in Cannabis) chemicals as vapor without burning the organic material and adding non-THC and CBD material to the inhalation gases.

Heating a chamber loaded with organic material may, in some instances, overheat at least portions thereof and therefore combust, overheat or otherwise release unwanted items which may include carcinogens and chemicals into the vapor.

It is therefore a desideratum to have a device, method and or system wherein such heating is better managed.

DESCRIPTION

Aspects of vaporizer systems and methods disclosed include a controller that manages heating of a zone at a selected exposure temperatures (SET) to vaporize organic compounds in a portion of material in the containment area in a chamber, and in accordance with one of variable, preselected and fixed times. In some instances the controller prohibits heating when a zone or region has already been heated for a predetermined time. In some instances the controller prohibits heating until chamber has been refilled. In some instances the controller may accept a user override to allow reheating of a chamber, a zone within the chamber or to heat multiple zones simultaneously.

Aspects of vaporizer systems and methods disclosed include a controller; a heating chamber with an open top surrounded by an annular wall and having a floor; vents in at least one of the annular wall and the floor; at least two heating elements in thermal contact with the heating chamber; wherein each heating element is separately controlled by the controller; a lid with an interface to close off the open top of the chamber; an intake connected to a fluid pathway passing from inside the lid; an on/off switch; a power supply; and, wherein the power supply is electrically connected to the heating elements and the controller via the on/off switch. The vaporizer system may further include at least one temperature sensor. The at least one temperature sensor may be connected to the controller and the controller in response to temperature sensor measurements adjusts the amount and/or timing of electricity provided to a turned on heating. The vaporizer system may further include an illumination communications system controlled by the controller. The vaporizer system may further include being placed at least partially in a case (which includes but is not limited to an encasement, enclosure, partial enclosure or other exterior shroud or housing). The vaporizer system may further include an illumination communications system controlled by the controller visible from the exterior of the case.

In some instances the controller has a clock, monitors and/or tracks the amount of time a heating element is at a predetermined range of temperature. In some instances the controller determines when a predetermined amount of heating time for a heating element has been reached and may turn off power to one or more heating elements. In some instances the controller determines if any of the zones has not timed out and then controls the heating of the untimed out zone until such time as the zone is heated for a predetermined amount of time.

The vaporizer system may further include a sensor which measured one or more of when the lid is place on the chamber and removed from the chamber. The vaporizer system may further include the controlled will not provide heating for any zone until such time as the lid has been placed on the chamber. In some instances the controlled will not provide heating for any zone until such time as the lid has been removed from the chamber.

Aspects of vaporizer systems and methods disclosed include a controller; a heating chamber with an open top surrounded by an annular wall and having a floor; vents in at least one of the annular wall and the floor; at least two heating elements in thermal contact with the heating chamber; wherein each heating element is separately controlled by the controller; a lid with an interface to close off the open top of the chamber; an intake connected to a fluid pathway passing from inside the lid; an on/off switch; a power supply; and, wherein the power supply is electrically connected to the heating elements and the controller via the on/off switch and wherein the controller controls heat to each zone heater based on one of a fixed time, a variable and a selected which may include when or if during a heating and use cycle a heating element has timed out and tracks, monitors, measures or otherwise counts that time.

In some instances the vaporizer system further includes at least one dividers which extended from the floor into at least a portion of the heating chamber. In some instances the fluid pathway in the lid further comprises one or more baffles to direct the air and vapor flow.

Aspects of portable vaporizer include an enclosure having vents forming a fluid pathway into the enclosure; a controller; a heating chamber comprising; an open top surrounded by an annular wall and having a floor; vents in at least one of the annular wall and the floor; at least two heating elements in thermal contact with the heating chamber; wherein each heating element is separately controlled by the controller; a lid with an interface to mate with the top of the enclosure and close off the open top of the chamber; an intake connected to a fluid pathway passing from inside the lid; an on/off switch;

a rechargeable battery power supply; and, wherein the power supply is electrically connected to the heating elements and the controller via the on/off switch.

The vaporizer may further include at least one temperature sensor connected to the controller and the controller in response to temperature sensor measurements adjusts the amount and/or timing of electricity provided to an active on heating. The vaporizer system may further include an illumination communications system controlled by the controller.

Aspects of vaporizer methods include using at least two separate heating elements to selectively heat up different portions of a common chamber; selectively controlling the heating elements by a controller; and, wherein at least one of the temperature and the time of heating is controlled by the controller. The methods may further include connecting at least one temperature sensor to the controller and wherein the controller in response to temperature sensor measurements adjusts the amount and/or timing of electricity provided to a turned on heating. Ins some instance the method includes communicating via illumination if the temperature of at least a portion of the common chamber is at a predetermined temperature.

A controller utilizing one or more temperature sensors maintains the camber exposure temperatures (SET). SET is selected from the group consisting of about 180 degrees F., about 200 degrees F., about 220 degrees F., about 240 degrees F., about 260 degrees F., about 280 degrees F., about 300 degrees F., about 320 degrees F., about 340 degrees F., about 360 degrees F. about 380 degrees F., 390 degrees F., 400 degrees F., 410 degrees F., 420 degrees F., 430 degrees F., and 440 degrees F.

FIGURES

The invention may be better understood by referring to the following figures. The components in the figures are not necessarily to scale, emphasis instead being placed upon illustrating the principles of the invention. In the figures, like reference numerals designate corresponding parts throughout the different views.

Figure 1A:
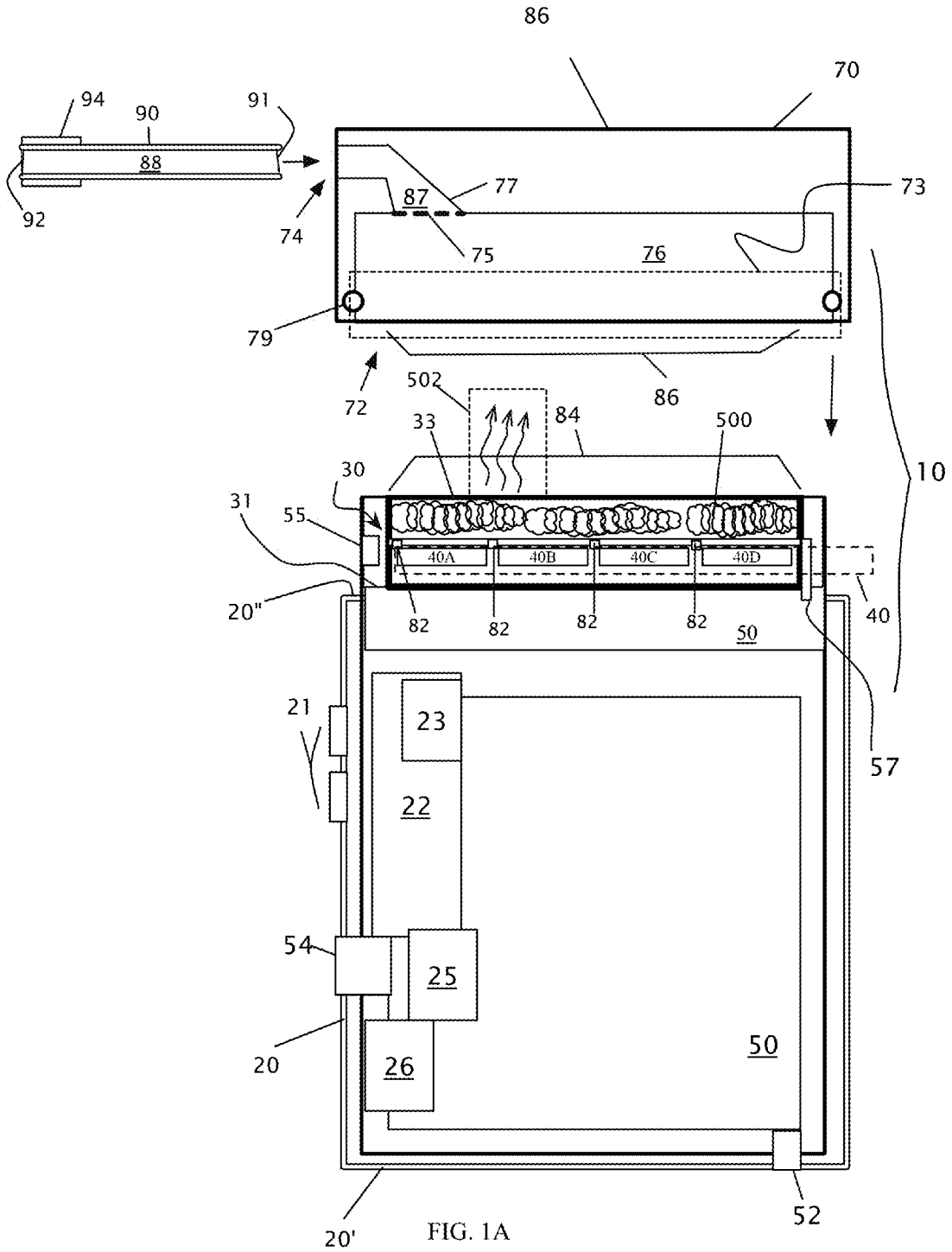
FIGS. 1A-1C illustrate aspects of a four zoned vaporizer.

All descriptions and callouts in the Figures and all content therein are hereby incorporated by this reference as if fully set forth herein.

FURTHER DESCRIPTION

In the following description of examples of implementations, reference is made to the accompanying drawings that form a part hereof, and which show, by way of illustration, specific implementations of the present disclosure that may be utilized. Other implementations may be utilized and structural changes may be made without departing from the scope of the present disclosure.

Vaporizing plant material for inhalation of plant borne chemicals is considered by some to be less harmful then combusting the plant material. Tobacco and cannabis are examples of such material.

It is appreciated by those skilled in the art that some of the circuits, components, controllers, modules, and/or devices of the system disclosed in the present application are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical such as, for example, conductive wires, electromagnetic wave guides, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying analog and/or digital formats without passing through a direct electromagnetic connection. These information paths may also include analog-to-digital conversions ("ADC"), digital-to-analog ("DAC") conversions, data transformations such as, for example, fast Fourier transforms ("FFTs"), time-to-frequency conversations, frequency-to-time conversions, database mapping, signal processing steps, coding, modulations, demodulations, etc. The controller devices and smart devices disclosed herein operate with memory and processors whereby code is executed during processes to transform data, the computing devices run on a processor (such as, for example, controller or other processor that is not shown) which may include a central processing unit ("CPU"), digital signal processor ("DSP"), additional memory may be added, application specific integrated circuit ("ASIC"), field programmable gate array ("FPGA"), microprocessor, etc. Alternatively, portions DCA devices may also be or include hardware devices such as logic circuitry, a CPU, a DSP, ASIC, FPGA, etc. and may include hardware and software capable of receiving and sending information.

A multi-zone vaporizer which controls heating of a sub-area or subzones within a heating chamber is disclosed. In some instance the control include software, logic and controllers having hardware, memory and microprocessors to control the zone heating and limit, warn about or prevent reheating of a used zone. In some instance the vaporizer includes BLUETOOTH®, WI-FI® or other wireless communication to a smart phone to allow an application on the smart phone to control heating of subzones. In some instance the vaporizer includes BLUETOOTH®, WI-FI® or other wireless communication to a smart phone to allow an application on the smart phone to control temperature settings.

Traditional portable vaporizers with single chamber heating may eventually burn some of the organic material therein. Repeated heating of a chamber from walls or floor surrounding the chamber can eventually dry out and burn the material after essential oils have been released. This problem includes the heating of cannabis plant material and cannabinoid containing concentrate.

Vaporizers provide a flow pathway from heating unit to inhalation path to user. The heat a chamber which may be high temperature plastic such as Dupont's VESPEL™, metal, ceramic or the like and within the chamber is placed organic material such a plant matter or concentrate which is heated to release vapor. Concentrate may be on a carrier substance. In many cases overheating causes some burning and charring.

For cannabinoids release of gas/vapor other than THC or CBDs in the cannabis material is suboptimal. The temperature range for release of many cannabinoids from cannabis plant material (and extracts) is about 170 degrees C. to about 215 degrees C.

The instant disclosure teaches a heater body having a rechargeable battery, a controller, memory, temperature sensor, open close lid sensor, a removable lid, a heating chamber, a fluid pathway to inhale vapor from, a heater vent, and an air intake vent. Also, disclosed is an on/off switch, indicator lights and a recharge connection. Further disclosed are communication interfaces with a user such as illumination which may turn on/off, flash and/or change color to communicate or indicate a state, or a change of condition to the user. Audible and/or tactile (vibration) communication is also disclosed. Finally a screen such as a LCD is disclosed.

In some instances the heater is a single heater placed or moved into proximity with the material in a chamber to vaporize wherein heat is supplied. In some instances a controller, such as a microprocessor with hardware and/or software logic turns on/off heating element. In some instance multiple heating elements are used to form zones to heat different sections of the chamber at different times.

The instant disclosure also teaches aspects of a zoned vaporizer with a fluid pathway for air to pass through organic material in a chamber being heated for vaporization. In some instances heater elements are arrayed or zoned and the controller or controllers turn heater elements on/off to apply heat to a selected portion or portions of the chamber. The controller may utilize a look up table in memory to determine parameters of the heating and/or timing of the heating of each zone.

Figure 1B:
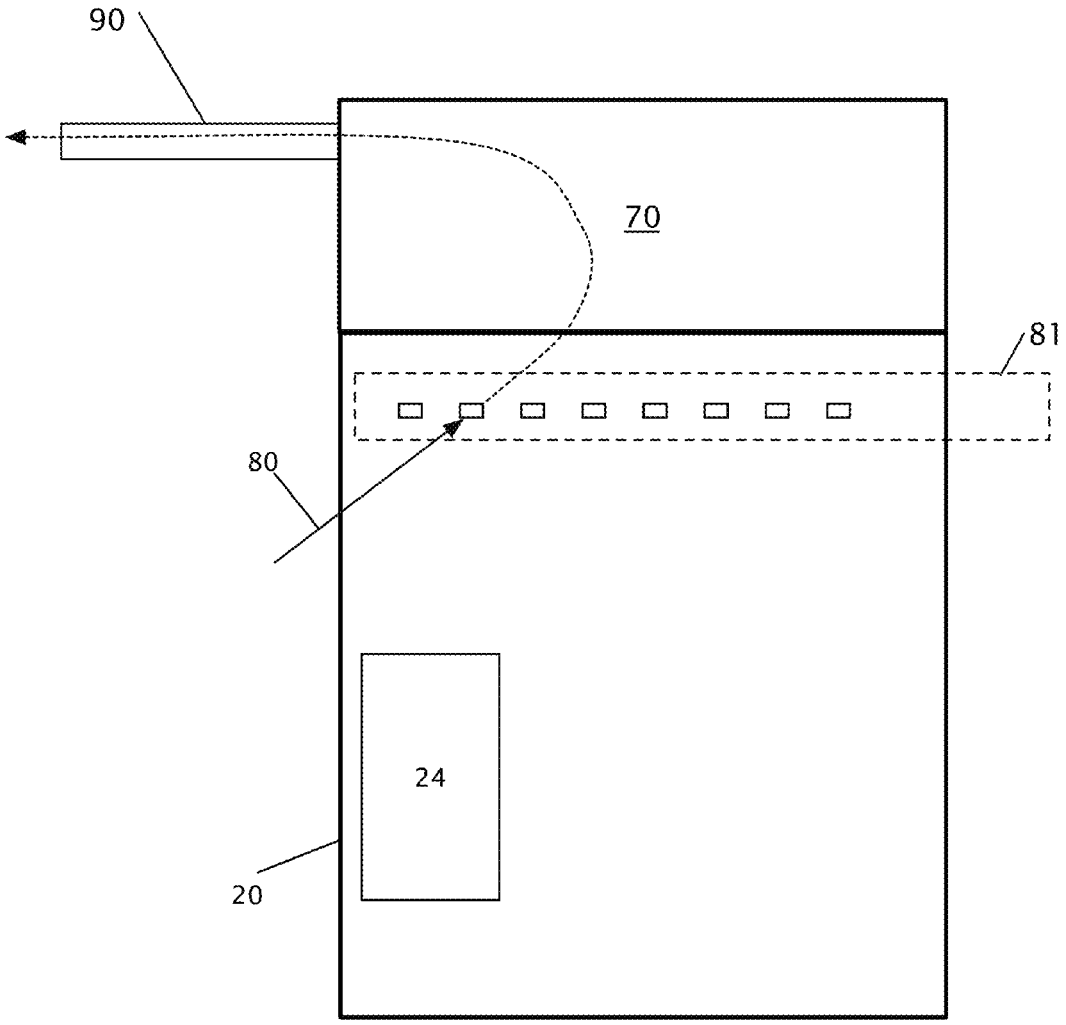
Figure 1C:
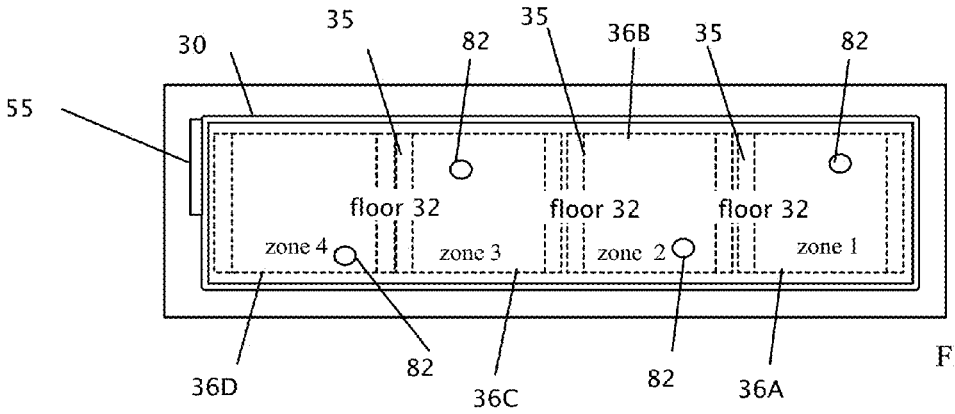

FIGS. 1A-1C discloses aspects of a vaporizer device 10 comprising an enclosure also referred to as a case 20 which may have one or more buttons 21 to communicate with a controller 22 which may have memory 23 therein. The enclosure is generally hollow it may have a closed bottom 20' and an open top 20" A communication display such as illumination via an electroluminescent screen, light emitting diode (LED) or a liquid crystal display 24 may be added, or communication with user may be via sound, or vibration. The case is covered with a removable lid. The case contains a heating chamber 30, with an annular wall 31, a floor 32 and an open top 33 which is in thermal communication with a heater system 40. In the heater system 40 are subzones. Subzone heating elements 40A-40D are in thermal contact with the floor 32 and may also wrap around the annular wall 31 to selectively apply heat as directed by the controller. A battery power supply 50 provides electricity to this portable device for functions of the controller, sensors, heater, and communications with user may be provided whereby a user can obtain status of the device or adjust settings. The battery power supply is at least one of rechargeable and replaceable. Insulation 50 may be added around the heater system 40. Within the chamber, zone insulation dividers 35 may be placed between the zones 36A-36D which are roughly above heating elements 40A-40D. The zone dividers may be flush with the floor, rise above the floor. Dividers may also be insulators to reduce thermal contact between material 500 in the regions or areas of the chamber.

A recharge connection 52 communicates through the enclosure or case for recharging the battery, it may be a USB or other power connection. Inside the case is a controller 22, optional I/O 54 may be a USB connector (or the like—THUNDERBOLT™) which may also provide recharging functions and data input/output. Additional memory via solid state device 25 may be provided. In some instances an optional wireless connection via WI-FI® 26 or BLUETOOTH®, WI-FI® or the like may be provide on the appropriate solid state device.

As part of the control system a lid on/off lid on/off sensor 55 can be provided. The sensor or actuator is a switch to interrupt power to the heater system if the lid is removed. The lid on/off can by used by the controller to reset the cycling of powering zone heaters when a lid has been removed after all zones have been heated for one of a fixed time, a variable time and a selected time. The selected time is selected by one of the user, a smart phone, and a controller. At least one temperature sensor 57 such as a thermistor or thermocouple is in close proximity to the heater system to communicate data to the controller whereby the energy provided to the heater system and subzones is modulated to maintain a selected temperature. Wireless connection allows connecting the device to a smart phone which can have software (applications) which pair with the device 10 and adjust operation of the device via the controller.

Methods disclosed include a controller that manages heating of a zone at a selected exposure temperatures (SET) to vaporize a portion of the material in the containment area in the chamber accordance with one of variable, preselected and fixed times. The heating of all heating elements while the chamber contains material and without removing the lid may also be refereed to as a cycle or a heating cycle. When a cycle is over the cycle has timed out. If the amount of time a specific heating element is to be heated is reached the heating of that element has timed out. The controller can track, monitor, measure or otherwise count that time.

In some instances the controller prohibits heating when a zone has already been heated for a predetermined time frame. In some instances the controller prohibits heating until the chamber has been refilled. In some instances the controller may accept a user over ride to allow reheating of a zone or to heat multiple zones simultaneously.

The case has a series of vents 81 which provide communication from the outside of the case to the inside. The lid 70 is removable, it has an open bottom 72 with an interface 73 for at least partially sealing off the top of the heating chamber and a mouth aperture 74 for inhalation, a screen 75 interposed between the inner cavity 76 of the lid and the outlet 77. An O-ring 79 or other seal may be interposed around the inner cavity to better seal the lid to the case. The device 10 provides a fluid inhalation pathway which draws outside air into the case through the chamber and out the lid. During inhalation, when the heating system is activated vapor form material 500 placed in the chamber is released and drawn through the fluid pathway to the user during the inhalation.

The fluid pathway 80 is limited by the apertures/vents of selected sizes and therefore can be used to roughly limit the amount of air that can be drawn by a inhalation of a predetermined force.

The fluid pathway starts with a series of vents 81 which provide communication from the outside of the case to the inside. A series of intakes 82 in the chamber 30 allow air to be drawn through the case into the chamber. The fluid pathway continues from the open top of the chamber 33 which forms a first fluid connection 84. The open bottom of the lid 74 forms a second fluid connection 86. The fluid pathway, in a assembled device, continues from the chamber through the first and second fluid connections and into the lid to the third connection 87 which is a fluid path in the outlet 77 and through the interface for inhalation 74. Optionally a generally tubular mouthpiece 90 with a first end 91 that mates with the interface 74 and a second end 92 for user inhalation can provide the exit path 88 for inhalation of fluid. In use, the heater system, heats up portions of the material 500 in the chamber and the vapors released therefrom 502 are moved through the fluid pathways of the device with the air which is moving through the fluid pathways during heating and inhalation. A flavor insert 94 may be added to the mouthpiece.

Figure 2:
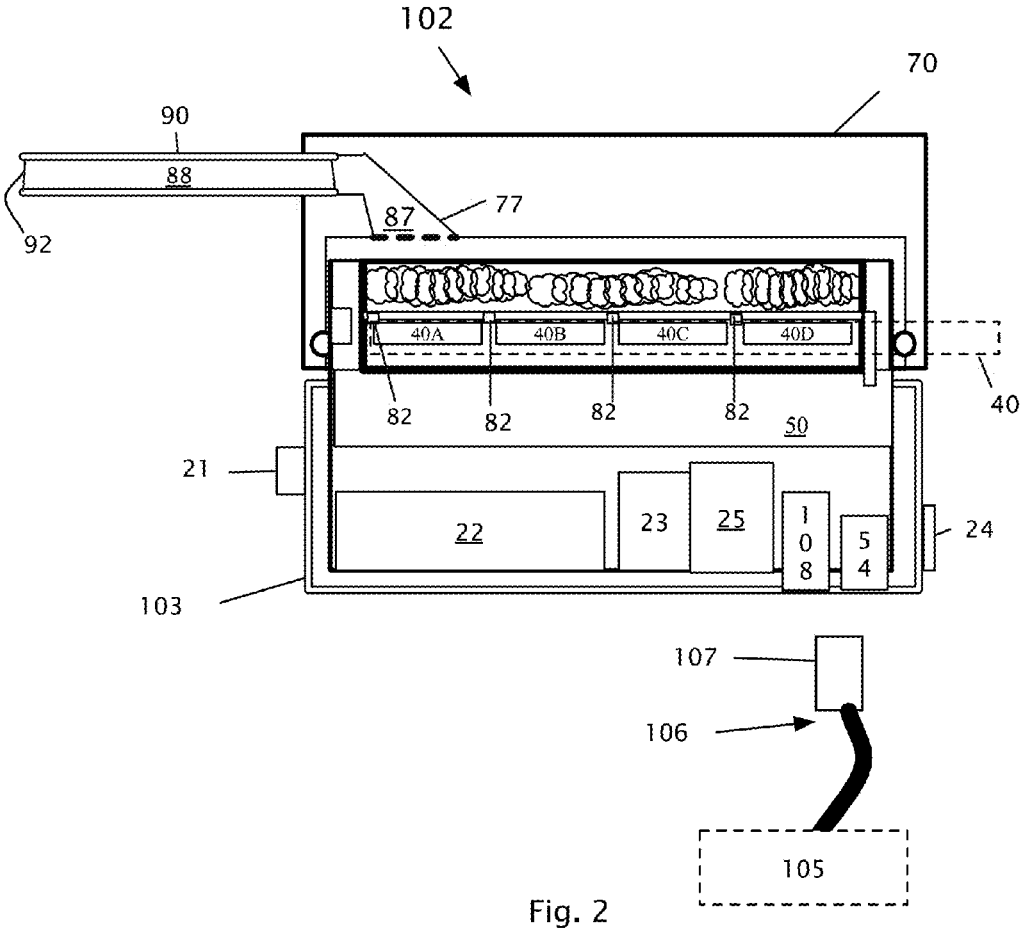
FIG. 2 illustrates a zoned heater system which uses remote power.
Figure 3:
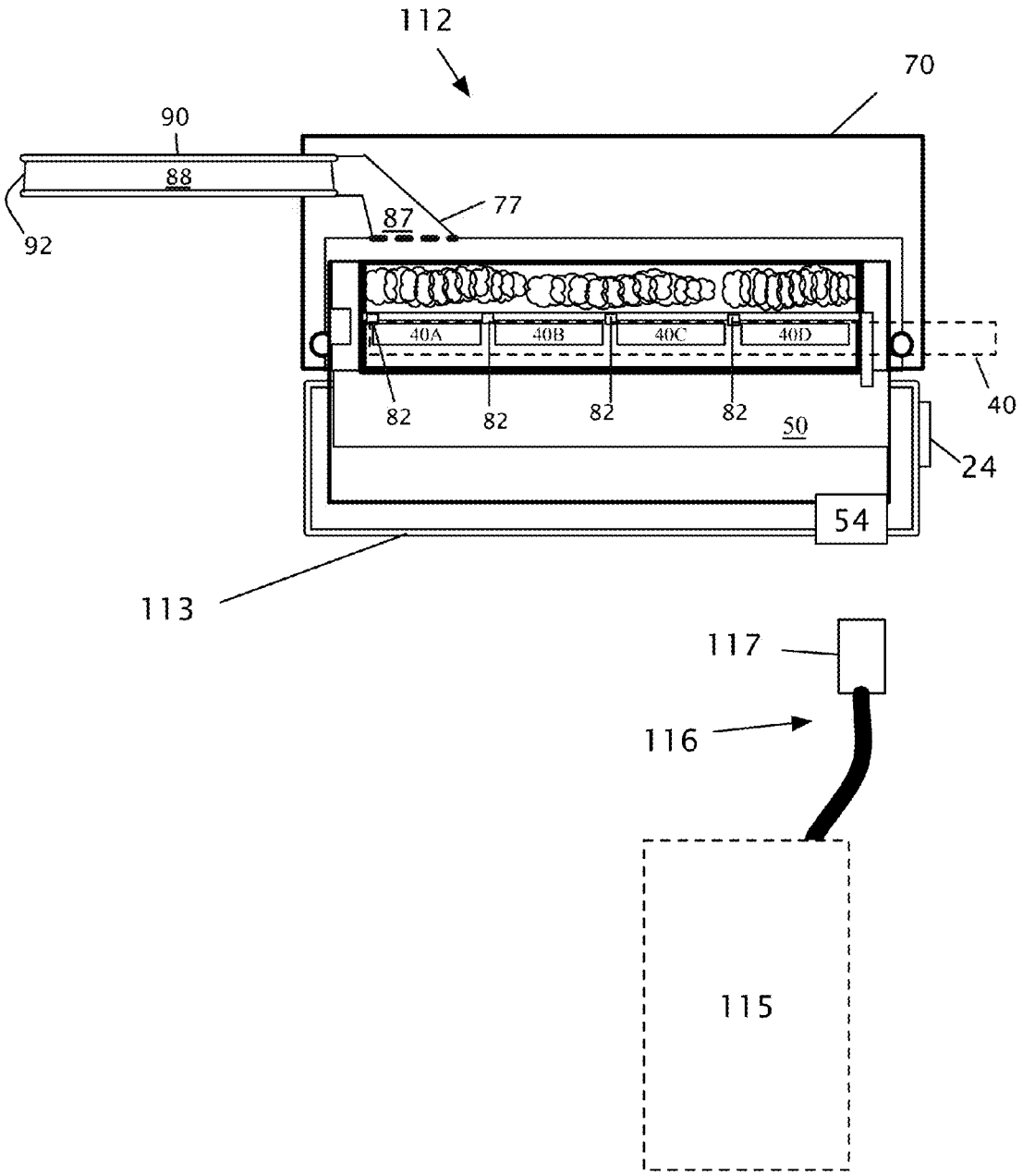
FIG. 3 illustrates a zoned heater system which uses remote controller and power.
Figure 4A:
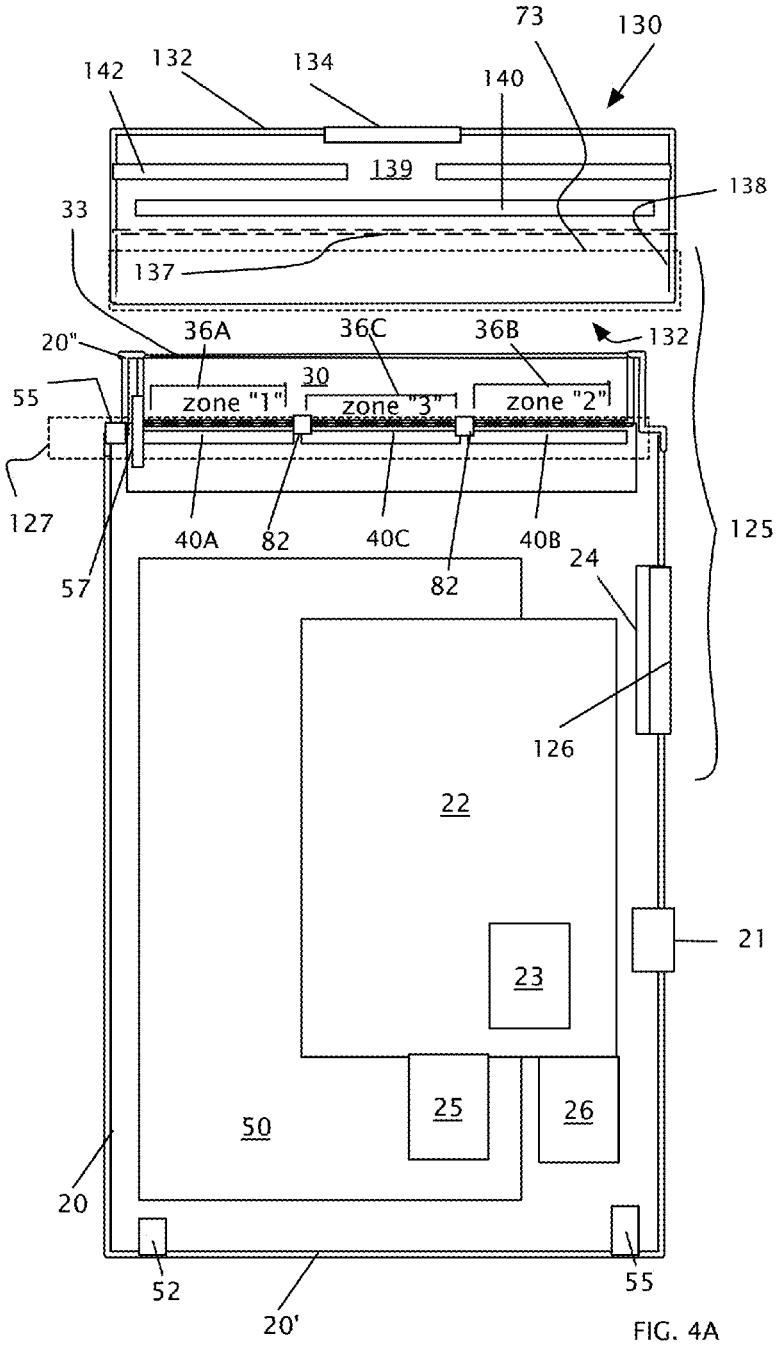
FIGS. 4A-4E illustrate aspects of a three zoned heating system.
Figure 4B:
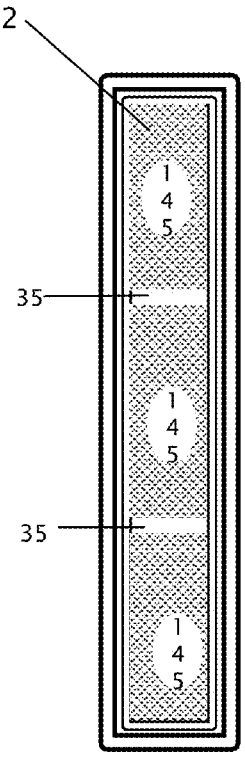
Figure 4C:
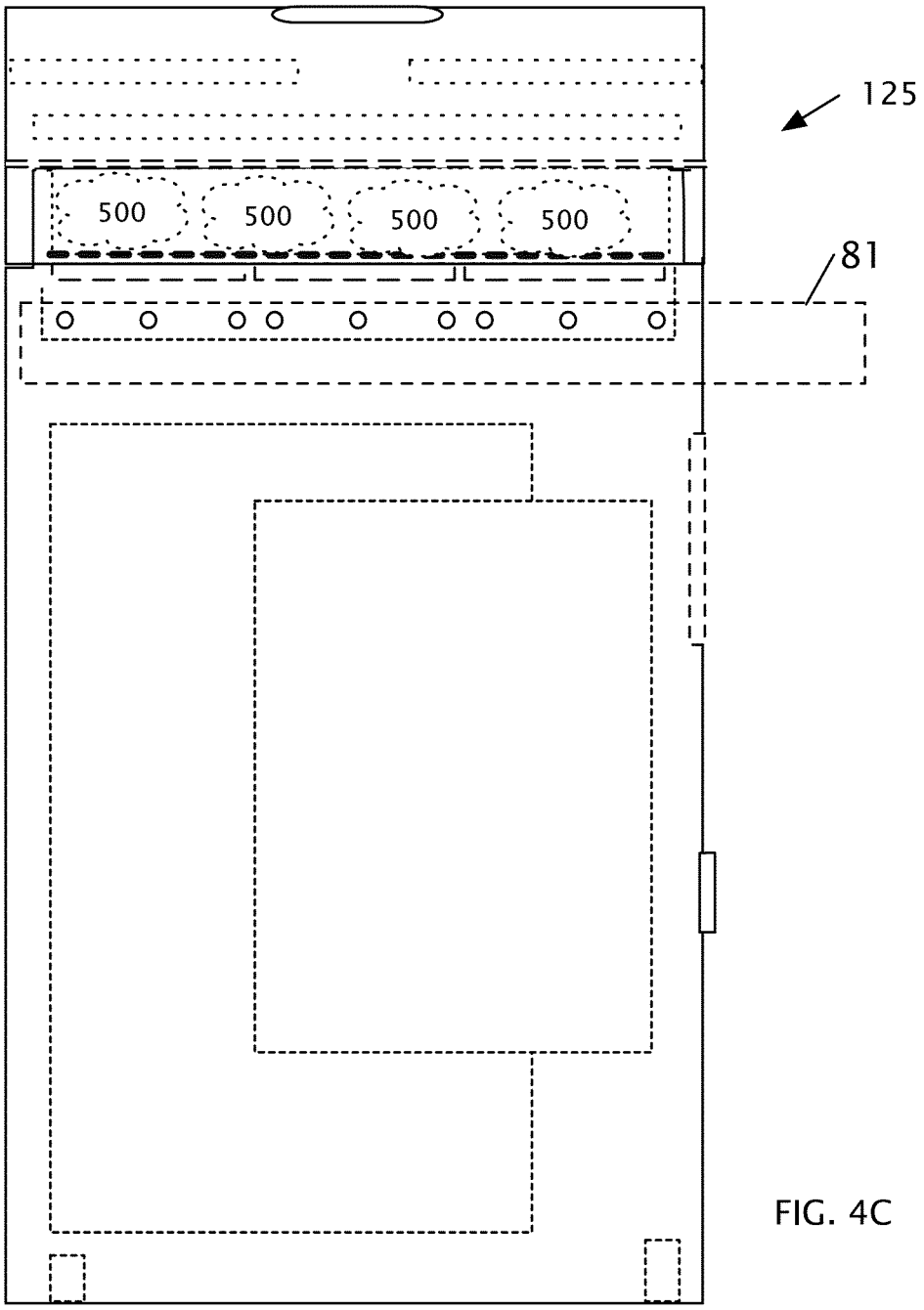
Figure 4D:
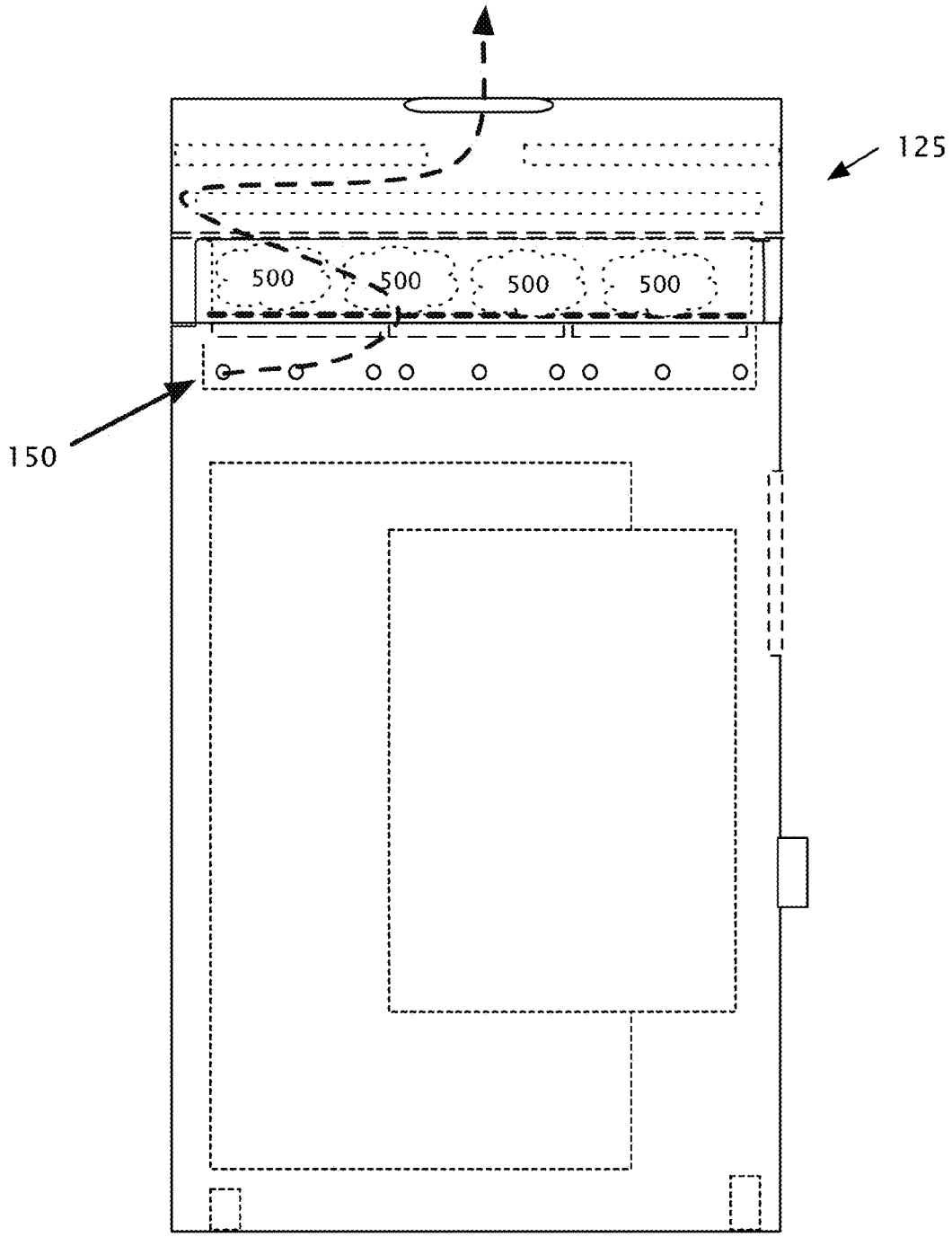
Figure 4E:
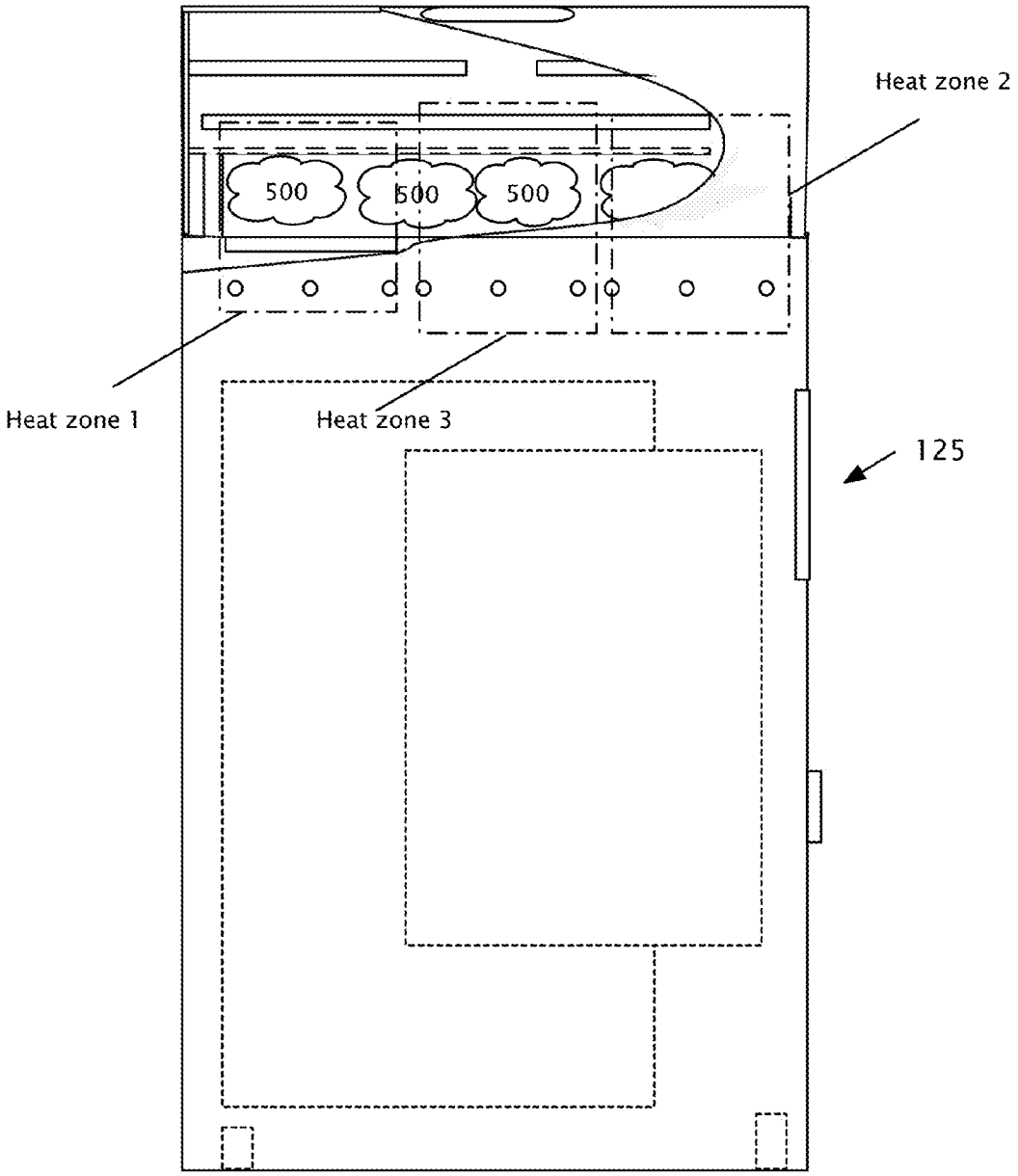
Figure 5A:
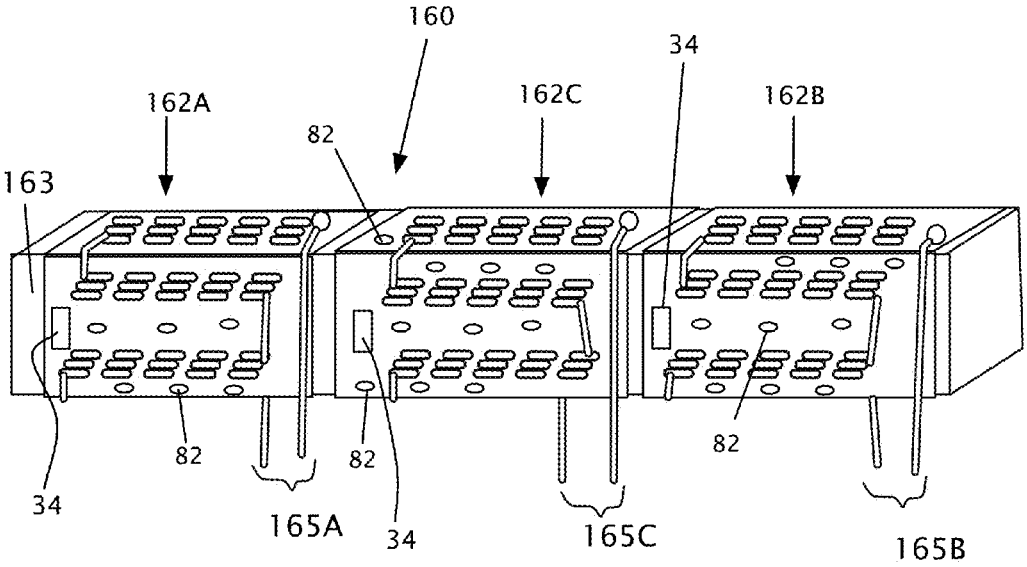
FIGS. 5A-5B illustrate a zoned conduction heating chamber and elements associated therewith.
Figure 5B:
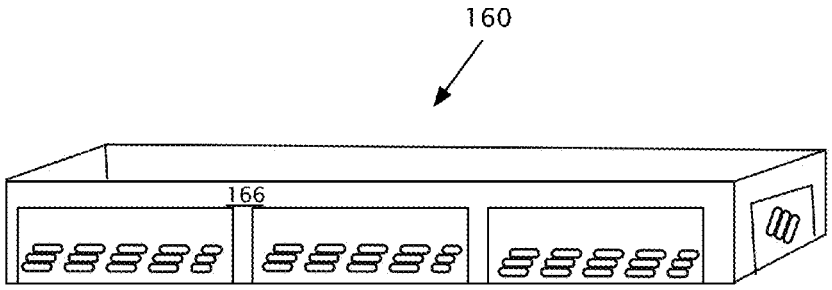

FIGS. 2 and 3 illustrate devices which utilize a similar multi zone heating system but leverage other devices for at least one of power and control. FIG. 2 illustrates a smart heating head device 102. It contains a heater system and lid with inhalation and fluid pathways as previously described however the case 103 does not contain a power suppl. The power supply 105 (such as lithium ion batteries, alkaline batteries, a fuel cell, or the like) is connected via a wired line 106 with a connector 107 that mates with a power input receptacle 108. The on/off switch 21 turns on the system and the controller 22 utilizes the remote but connected power supply to power the heating system. The controller and sensors control the device.

FIG. 3 illustrates a "dumb" heating head device 112. It contains a heater system and lid with inhalation and fluid pathways as previously described however the case 103 does not contain a power supply. The control and power supply device 115 (such as a smart phone) is connected via a wired line 116 with a connector 117 that mates with the I/) 54. The control and power supply device 115 turns on/off the heating system and via the sensors in the device 112 processes the data and controls the heating system.

FIGS. 4A-4E discloses aspects of a three zone vaporizer device 125 having a baffled cooling head lid. The device and system include a chamber for heating material. The chamber has a floor with vents that communicate into the chamber whereby heating elements in thermal communication with the chamber heat at least a portion of the chamber and material therein. A lid couples to or otherwise partially seals off the top of the heater chamber and also provides a fluid pathway from the partially sealed chamber to an intake passing from the lid whereby a user may inhale vapor for the material. The system may further comprise a case or enclosure 20 which may have one or more buttons 21 to communicate with a controller 22 which may have memory 23 therein. A communication display such as illumination via light emitting diode (LED) or a liquid crystal display 24 may be added, or communication with user may be via sound, or vibration. The case is covered with a removable lid. A translucent to transparent lens 126 may be added above the display and is useful to diffuse communication from an LED source. The case contains a common heating chamber 30, with an annular wall 31, a floor 32 and an open top 33 which is in thermal communication with a heater system 127. In the heater system 40 are subzones. Subzone heating elements 40A-40C are in thermal contact with the floor 32 and may also wrap around the annular wall 31 to selectively apply heat as directed by the controller. The heating zones 36A-36C are offset as part of a method of heating. Zone "1" (36A) is on one side of the chamber above a first heating element 40A. Zone "2" (36B) is at the other side of the chamber above the second heating element 40B. In between zone "1" and zone "2" is zone "3" (36C) above heating element 40C. By heating the two side zones and then the center zone the local heat is separated by physical space avoiding some heat spill over from heating zone "1" into heating zone "2" which in turn may preserve more of the cannabinoids that remain in zone "2" for the next usage. If all zones are heated at the same time cannabinoids which vaporize at lower the 400 F degrees will be vaporized during the initial heating and inhalation thereby providing less of these potentially beneficial cannabinoid in subsequent inhalations or for second or third users sharing a device. The communication display may indicate to a user if the device is active, ready for inhalation, needs a recharge, needs a refill of material or is still heating at least a portion of the common chamber.

The case has a series of vents 81 which provide communication from the outside of the case to the inside. The lid 130 is removable, it has an open bottom 132, an interface 73 and an outlet 134 for inhalation, a screen 137 is interposed between the case interface 138 of the lid and the fluid cavity 139. A series of baffles 140 & 142 are formed within the fluid cavity 139 whereby the fluid pathway 150 from the exterior of the case, through the vents 81 to the user is direct in part by the baffles. The floor of the camber 145 may be substantially permeable to airflow such as a fine mesh, a metal or ceramic foam, or a series of laser drilled apertures.

FIGS. 5A-6C illustrate variations on a zoned heating chamber using induction or conduction heater elements in close proximity to the exterior annular wall of the heating chamber.

Chamber 160 is generally elongated, although shown as rectangular those of ordinary skill in the art will recognize that adding a radius to the corners and a draft angle or slope to the walls is within the scope of the disclosure. Air flow into the chamber is through intake vents 82. The zoned heating utilizes separate heating elements 162A-C. The elements are in thermal contact with the annular wall 163 of the chamber. Each heating element has electrical contacts 165A-C which are connected to the controller (not shown) whereby the zone that is being heated is turned on and off and the temperature thereby is adjusted. Temperature sensors 34 such as thermistors and thermocouples are placed near each zone heater and are electrically connected to the controller (not shown). The heating elements 162A-C may wrap around the sides 166 of the annular wall.

Chamber 170 is generally elongated, although shown as rectangular those of ordinary skill in the art will recognize that adding a radius to the corners and a draft angle or slope to the walls is within the scope of the disclosure. The chamber may be constructed of metal, ceramic, high temperature plastic, it may be metallized plastic, formed of glass such as quartz glass or borosilicate. A shaped chamber may have thickened sections which form part of the insulator dividers 35 (which are optional).

Figure 6A:
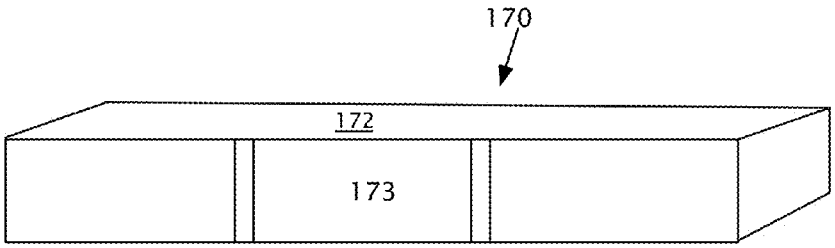
FIGS. 6A-6C illustrate a zoned conduction heating chamber and elements associated therewith.
Figure 6B:
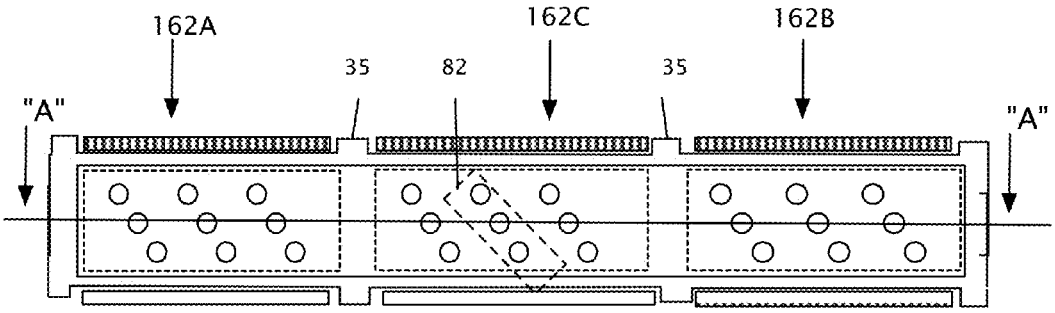
Figure 6C:
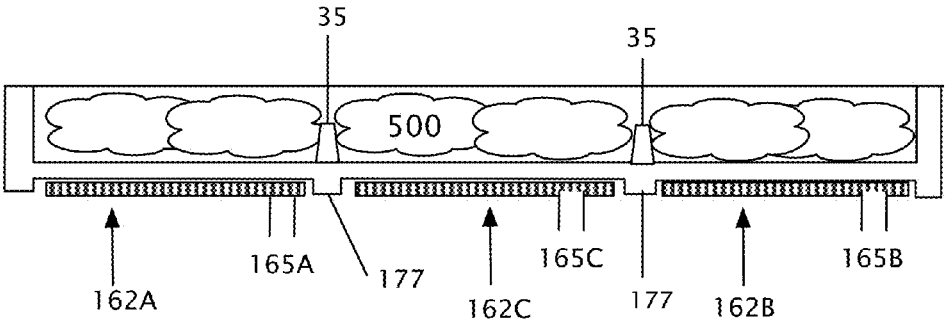

FIG. 6A is a bottom perspective view of the chamber, FIG. 6B is bottom view of the chamber. FIG. 6C is a cut-away view along the line of "A"-"A" of FIG. 6B. Air flows into the chamber 170 through intake vents 82. The zoned heating utilizes separate heating elements 162A-C. The elements are in thermal contact with the annular wall 172 of the chamber. Each heating element has electrical contacts 165A-C which are connected to the controller (not shown) whereby the zone that is being heated is turned on and off and the temperature thereby is adjusted. Temperature sensors 34 such as thermistors and thermocouples are placed near each zone heater and are electrically connected to the controller (not shown). The heating elements 162A-C may wrap around the sides 173 of the annular wall. Extended heat sinks or cooling fins 177 may be formed as part of the chamber or affixed thereto to assist with heat management in the chamber and zones.

Figure 7:
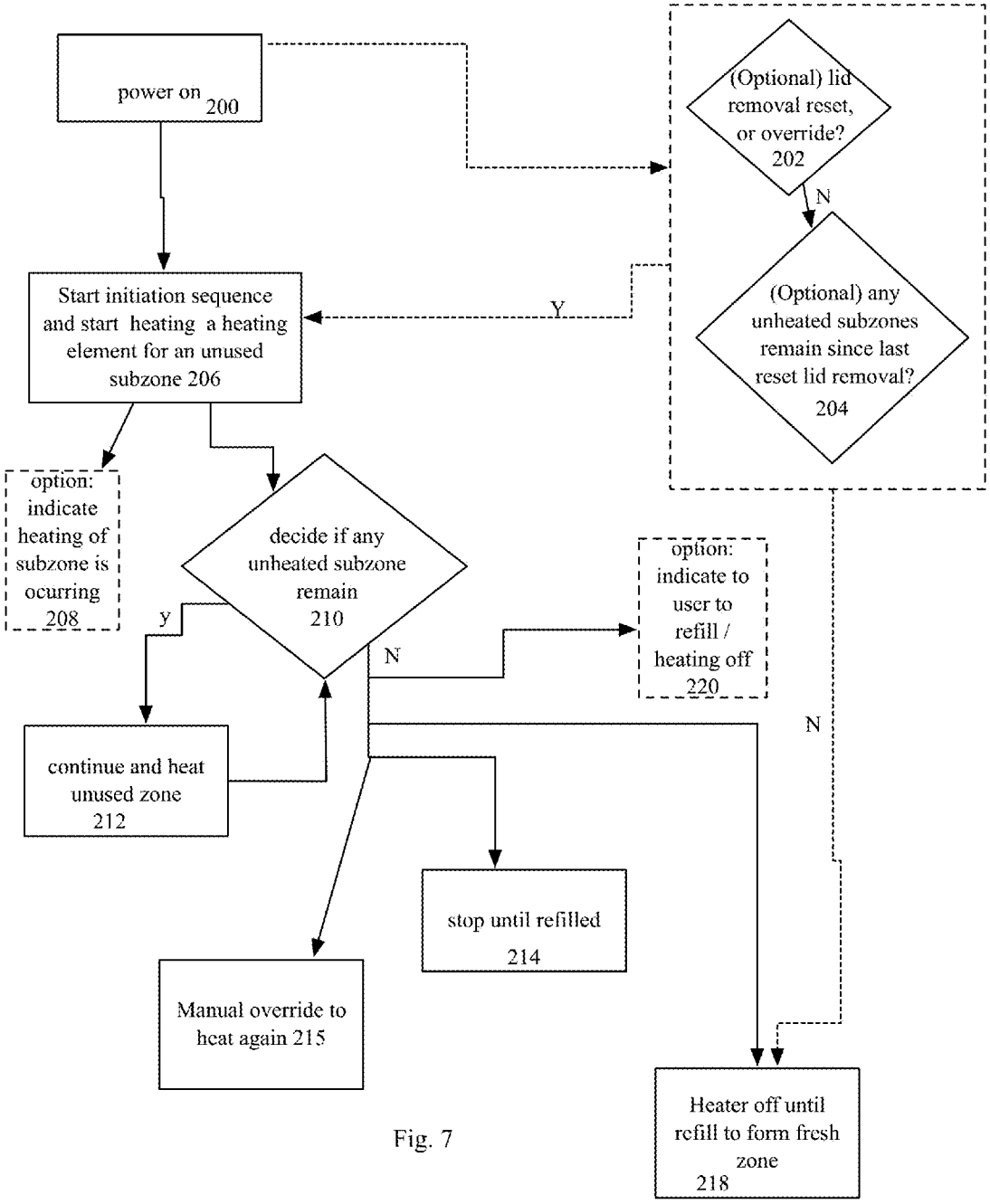
FIG. 7 illustrates some of the electrical and control connects to the controller.

FIG. 7 is a process diagram of aspects of controller logic for a vaporizer. Power is turned on 200 for the device. Optional determine if heating chamber has gone through a full cycle of heating all subzones without lid/cover removal or user override 202, if not, then optionally decide if any unheated zones remain 204. Next, start an initiation sequence to heat a heating element for an unused subzone 206. Optionally, indicate via indicator light to user that heating is occurring 208. Determine if any unheated heat subzones remain 210. If unheated subzone remains heat an unused subzone 212. If all heating subzones have been used stop 214. Turn heating elements off and do not heat until confirmation of refill, such as lid removal, or a user override to have one last attempt to extract additional vapor by reheating used subzones either individually or as a group 215. After heating a heating subzone determine if the heating sequence has heated all heating zones and is complete 210. If completed sequence turn off heating until lid removed for refill 218. If sequence is complete and heating of subzones is stopped indicate to user via indicator lights 220.

Figure 8:
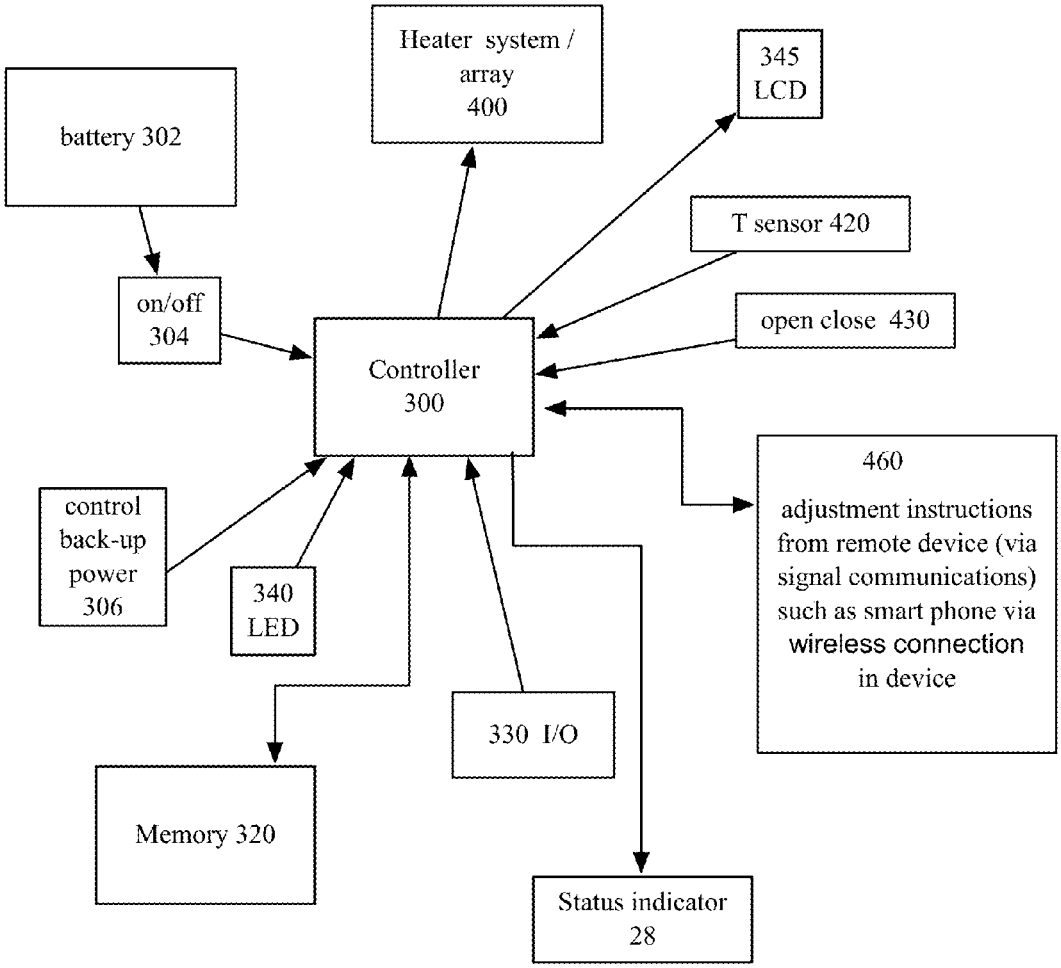
FIG. 8 illustrates aspects of the control logic of zoned heating.

FIG. 8 shows a aspects of a controller 300 in electrical and/or signal communication with other system sensors and components. The battery 302 to power the controller and the device is connected to an on/off switch 304 wherein power is supplied to the controller. Optionally the system may have a back-up battery power supply 306 which supplies power to the controller or other components when the main battery (302) is disconnected. Alternatively memory either volatile or non-volatile will store data on system parameters when the controller is not powered. The controller instructs the on/off of heating elements within the heating system 400. One or more temperature sensors 420 provide temperature measurements to the controller. A open/close sensor 430 is used to determine if the lid of the device has been removed and may be used to reset the initiation sequence based on assumptions such as an opened lid equates to a refilled heating chamber. The controller can be in signal communications with memory 320. Communication between a computer or smart phone with the controller may be via an input/output 330. Input to the controller may also be via the input buttons 332 and a status indicator such as a colored LED communication illumination 340 and/or an LCD 345 type display can show a setting such as the heat setting for the heating chamber or the length of time of each heating cycle. The LCD 345 and the status indicator 340 are controlled by the controller whereby a status such as heating a heating element is indicated or system has determined the zones have all been heated and heating has been stopped, or the device needs to be recharged. In some instances the controller may receive adjustment instructions via a computing device of smart phone in wireless signal communication with the controller 460.

It will be understood that various aspects or details of the disclosures may be changed combined, or removed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. A vaporizer system comprising:
- a controller;
- a heating chamber comprising;
  - an open top surrounded by an annular wall and having a floor;
  - vents in at least one of the annular wall and the floor;
  - at least two heating elements in thermal contact with the heating chamber;
  - wherein each heating element is separately controlled by the controller;
- a lid with an interface to close off the open top of the chamber;
- an intake connected to a fluid pathway passing from inside the lid
- an on/off switch;
- a power supply; and,
- wherein the power supply is electrically connected to the heating elements and the controller via the on/off switch.

2. The system of claim 1, further comprising at least one temperature sensor.

3. The system of claim 2 wherein the temperature sensor is connected to the controller and the controller in response to temperature sensor measurements adjusts the amount and/or timing of electricity provided to a turned on heating.

4. The system of claim 1 further comprising an illumination communications system controlled by the controller.

5. The system of claim 1 further comprising a case surrounding at least the heating chamber.

6. The system of claim 5 further comprising an illumination communications system controlled by the controller visible from the exterior of the case.

7. The system of claim 1 wherein the controller at least one of monitors the amount of time a heating element is at a predetermined range of temperature and monitors when a predetermined time is met.

8. The system of claim 7 wherein the controller determines if any zone or heating element has not timed out and then controls the heating of the untimed out zone until such time as it is heated for a predetermined amount of time.

9. The system of claim 8 further comprising a sensor which measured one or more of when the lid is place on the chamber and removed from the chamber.

10. The system of claim 9 wherein the controller will not provide heating for any zone until such time as the lid has been placed on the chamber.

11. The system of claim 9 wherein the controlled turns will provide heating for any zone until such time as the lid has been removed from the chamber.

12. The system of claim 10 wherein the controller controls heat to each zone heating element based on one of a fixed time, a variable time and a selected time.

13. The vaporizer system of claim 1 further comprising at least one divider; and, wherein the divider at least one of divides at least a portion of the annular wall or extended from the floor into at least a portion of the heating chamber.

14. The vaporizer system of claim 1 wherein the fluid pathway in the lid further comprises one or more baffles to direct the flow of vapor.

15. A portable vaporizer comprising:

an enclosure comprising;

vents forming a fluid pathway into the enclosure;

a controller;

a heating chamber comprising;

an open top surrounded by an annular wall and having a floor;

vents in at least one of the annular wall and the floor;

at least two heating elements in thermal contact with the heating chamber;

wherein each heating element is separately controlled by the controller;

a lid with an interface to mate with the top of the enclosure and close off the open top of the chamber;

an intake connected to a fluid pathway passing from inside the lid an on/off switch;

a rechargeable battery power supply; and, wherein the power supply is electrically connected to the heating elements and the controller via the on/off switch.

16. The vaporizer of claim 15, further comprising at least one temperature sensor connected to the controller and the controller in response to temperature sensor measurements adjusts the amount and/or timing of electricity provided to a heating element.

17. The vaporizer of claim 15 further comprising an illumination communications system controlled by the controller.

* * * * *